US005659898A

United States Patent [19]

Bell, Jr.

[11] Patent Number: 5,659,898

[45] Date of Patent: Aug. 26, 1997

[54] EXERCISE SUIT HAVING FLEXIBLE ELONGATED WEIGHTS BETWEEN ELASTIC FABRIC LAYERS

[76] Inventor: Charles Bell, Jr., 3512-A Southridge Dr., Austin, Tex. 78704

[21] Appl. No.: 324,625

[22] Filed: Oct. 18, 1994

[51] Int. Cl.[6] ..... A41D 11/00; A63B 21/065

[52] U.S. Cl. ..... 2/69; 2/227; 2/228; 2/115; 482/105; 482/124

[58] Field of Search ..... 2/69, 79, 70, 227, 2/228, 237, 238, 255, 256, 273, 115, 2; 482/105, 121, 124, 131, 74

[56] References Cited

U.S. PATENT DOCUMENTS

| | | | |
|---|---|---|---|
| 3,759,510 | 9/1973 | Jackson, Jr. | 482/105 |
| 4,065,814 | 1/1978 | Fox | 2/227 |
| 4,268,917 | 5/1981 | Massey | 2/102 |
| 4,384,369 | 5/1983 | Prince | 2/79 |
| 4,698,847 | 10/1987 | Yoshihara | 2/67 |
| 4,910,802 | 3/1990 | Malloy | 2/70 |
| 4,953,856 | 9/1990 | Fox | 2/69 |
| 4,958,386 | 9/1990 | Louis-Jeune | 2/247 |
| 5,010,596 | 4/1991 | Brown et al. | 2/247 |
| 5,046,194 | 9/1991 | Alaniz et al. | 2/69 |
| 5,201,074 | 4/1993 | Dicker | 2/227 |
| 5,357,637 | 10/1994 | Moore | 2/227 |

*Primary Examiner*—Gloria Hale

[57] ABSTRACT

An elastic body suit constructed of two breathable, durable elastic layers quilted together over a series of flexible weights. The first, inner layer of elastic is lighter than the second, outer layer. Air ports for body cooling and air circulation at the arm pits and the backs of the knees are formed from the inner layer. The flexible weights are constructed of polyurethane and metal blended material made through an extrusion process normally used for making tubing and hoses. The suit can be made with an optional third layer of stretchable material to enhance its appearance, i.e.—spandex or latex.

16 Claims, 10 Drawing Sheets

Fig. 1

EXERCISE SUIT HAVING FLEXIBLE ELONGATED WEIGHTS BETWEEN ELASTIC FABRIC LAYERS

BACKGROUND OF THE INVENTION

The invention is in the field of weighted exercise suits and devices.

SUMMARY OF THE INVENTION

The present invention is a weighted, elastic body suit for toning and strengthening all muscle groups found between the neck, waist, wrist and ankle's of a wearer's body.

Each embodiment of the suit is comprised of flexible, elongated weights quilted between two elastic fabric layers wherein each fabric layer has a different tension and stretchability. The suit is formed of a first inner layer and a second outer layer wherein the inner layer of elastic fabric is lighter weight than the second elastic fabric layer. The inner layer allows more flexibility and movement over the elongated flexible weights and the outer layer allows greater resistance giving a conforming fit during athletic activities.

The suit can be formed in various different embodiments that are specific to the wearer's body such as male or female and to the activity it is used for such as swimming, jogging, skating, bicycling, volleyball, aerobics or other sport activities. In the full body version the suit covers the wearer's torso, arms and legs and the elongated flexible weights extend the full length of the wearer's body and encompass the entire body of the wearer with the exception of the quilted spaces between each individual weight. The suit will not cover the hands, upper neck, head or feet of the wearer, but shall be made with elastic stirrups at the feet of the wearer for added tension and support. A swimsuit version includes weights that extend the full length of the upper body of the wearer from the weighted, tapered neckline to the weighted tapered buttocks. The weights are quilted between the two elastic fabric layers. A short legged suit can also be formed.

Each embodiment can include ventilating air ports at the armpits or backside of the wearer's knees. The air ports are provided for body cooling and air circulation in those locations and are formed by eliminating the second layer in those areas and leaving just the inner fabric layer. The inner elastic fabric layer is the least condensed layer of elastic fabric.

BRIEF DESCRIPTION OF THE DRAWINGS

The descriptive embodiment of the present invention, taken with the accompanying, illustrative drawings readily gives meaning and understanding to the objects and features of the invention.

DETAILED DESCRIPTION OF THE INVENTION

Figure 1:
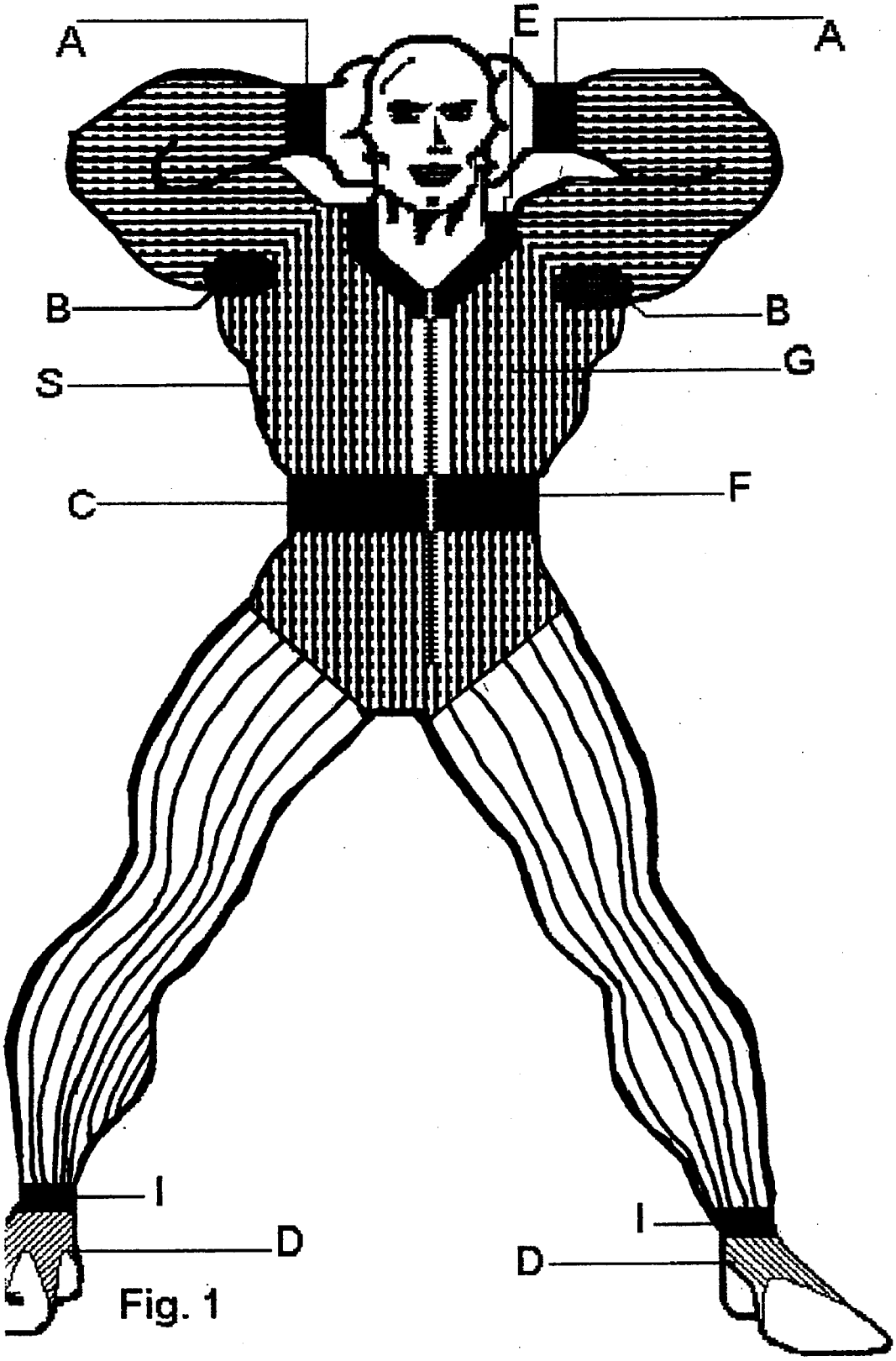
FIG. 1 illustrates a frontal view of the full body, male version of the weighted exercise suit.
Figure 2:
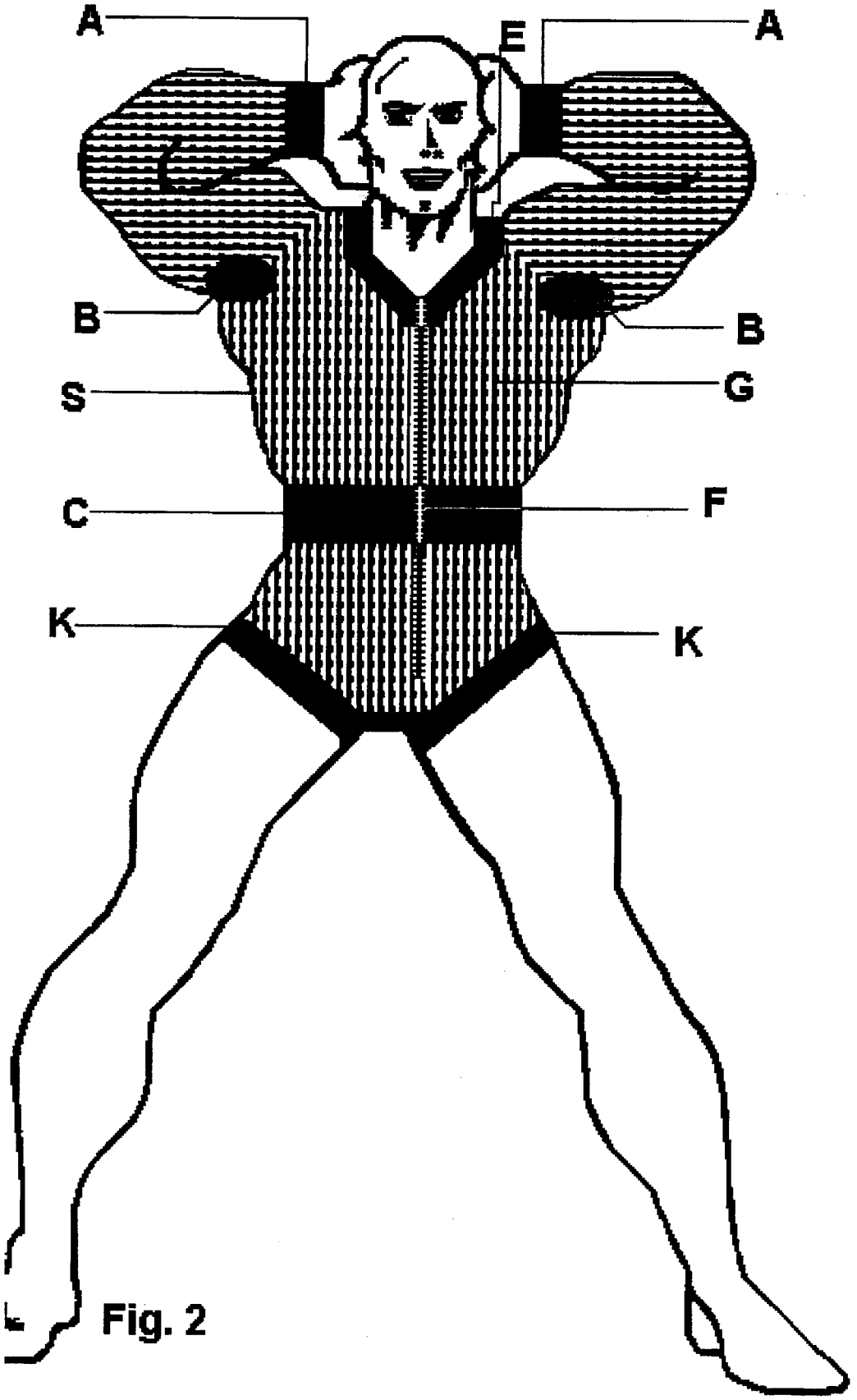
FIG. 2 illustrates a frontal view of the male, swimsuit style, upper body version having air ports in the armpit areas of the weighted, exercise suit.
Figure 3:
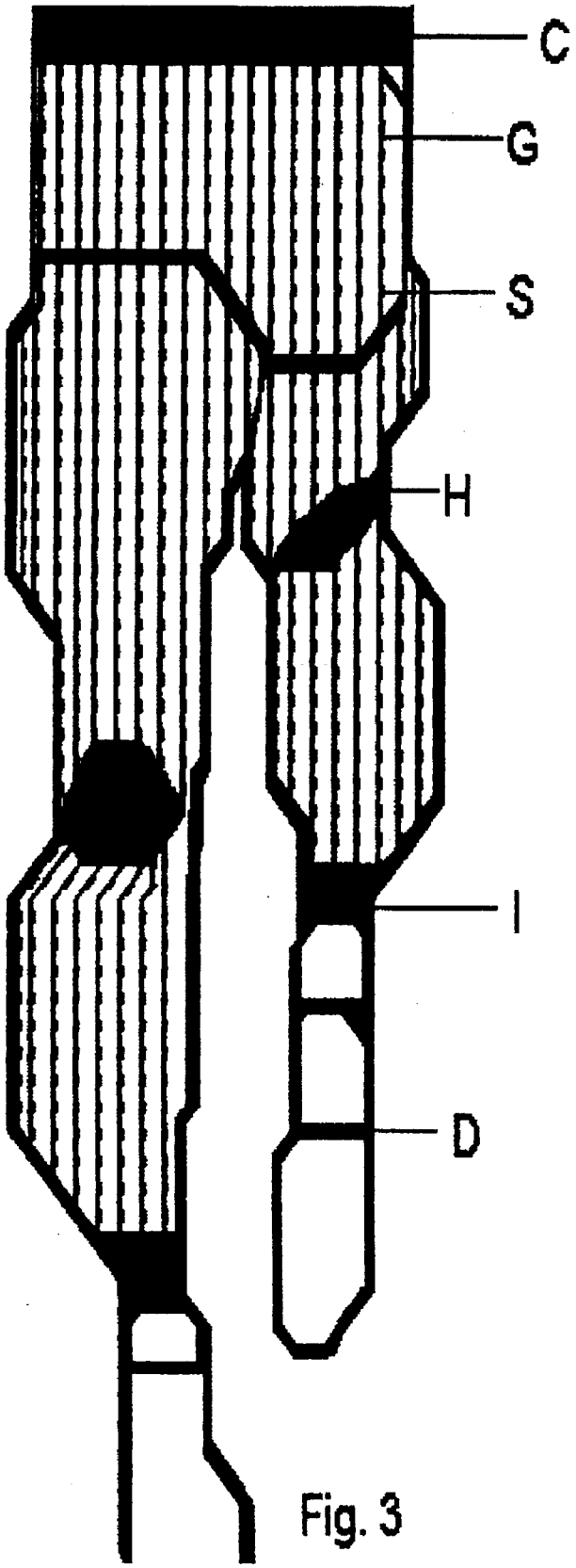
FIG. 3 illustrates a rear view of the leg portion and the air ports at the back of the knees of the female version of the weighted, exercise suit.
Figure 4:
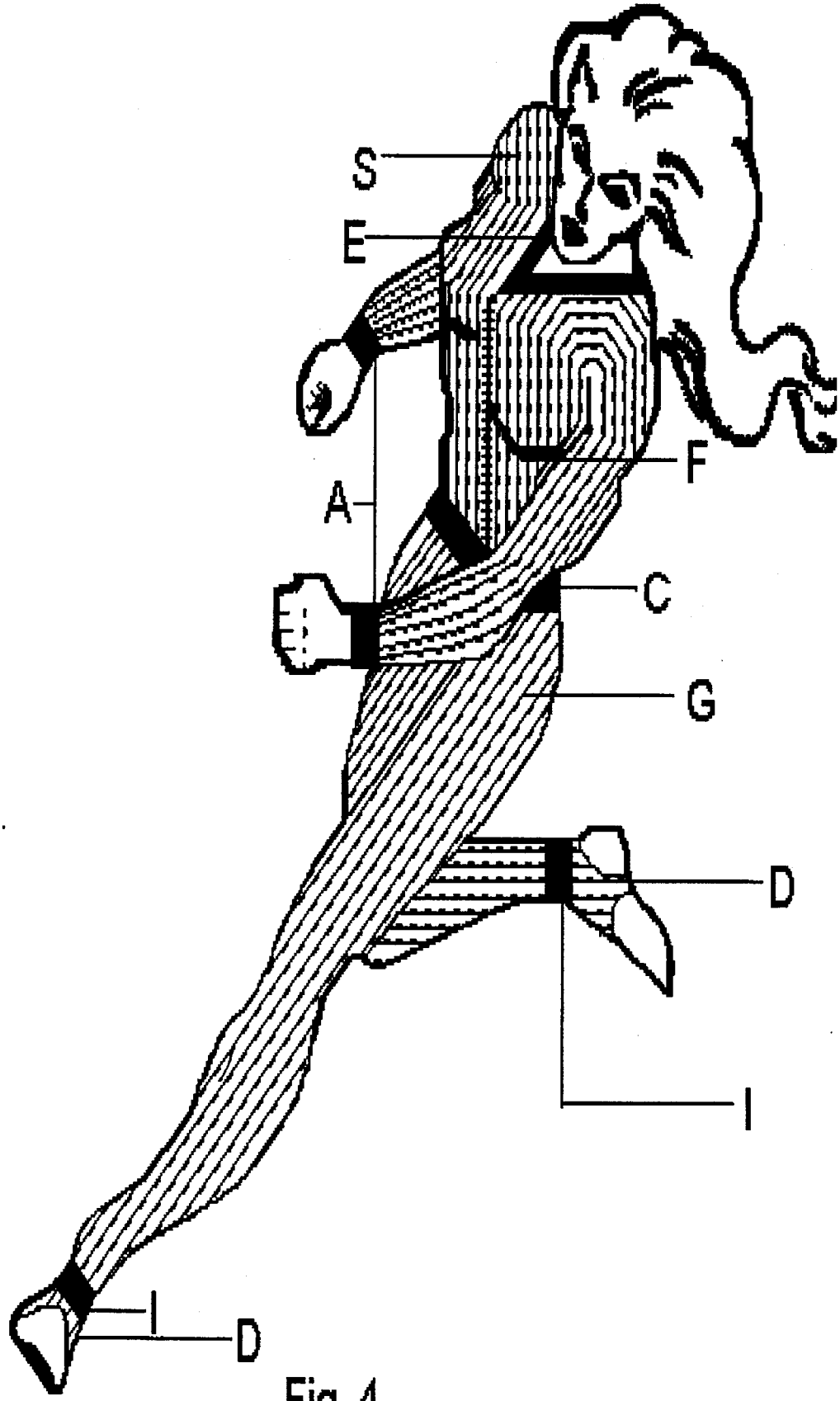
FIG. 4 illustrates a running view of the full body, female version of the weighted, exercise suit.
Figure 5:
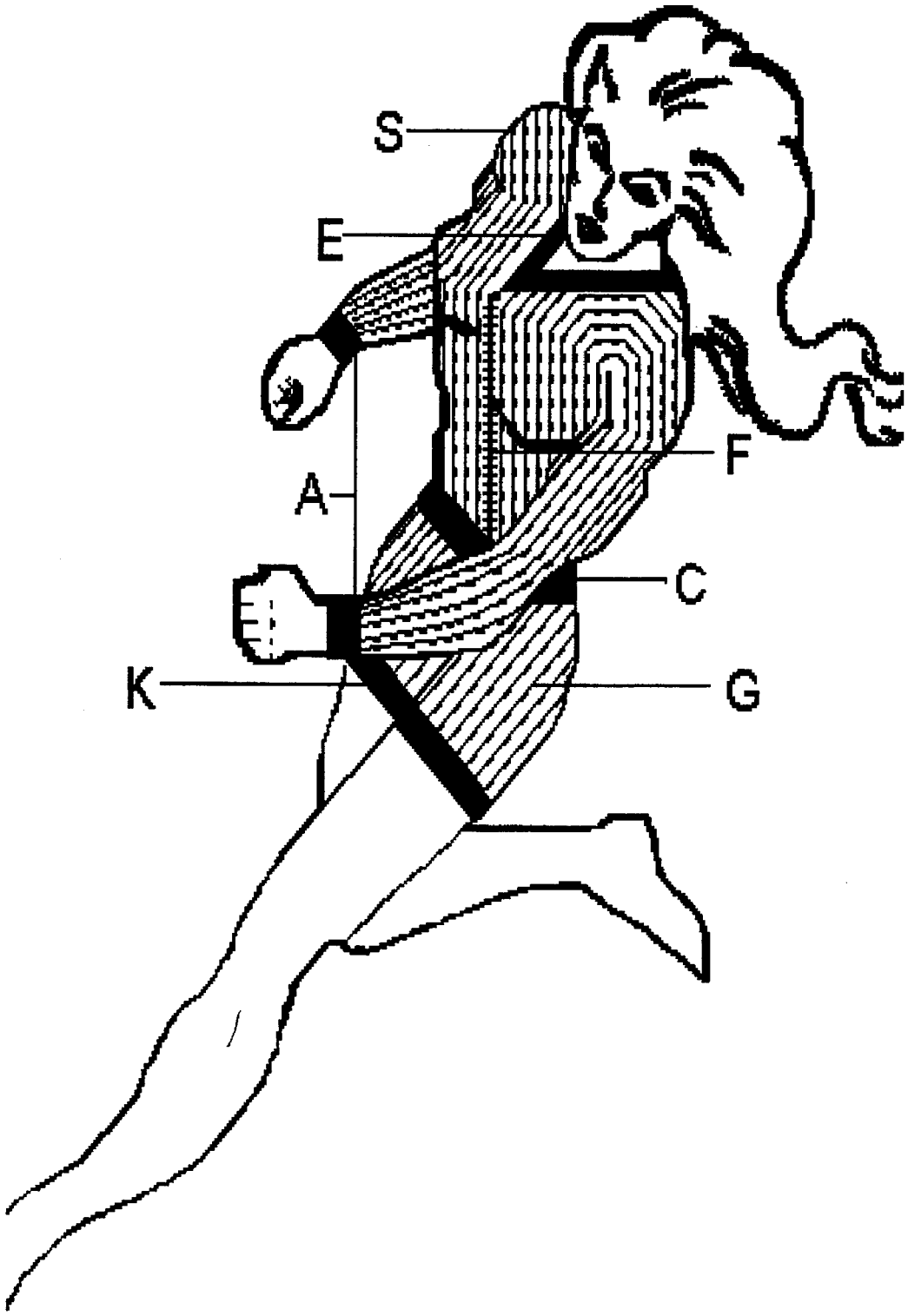
FIG. 5 illustrates an angular, frontal running view of the female, swimsuit version of the weighted exercise suit.
Figure 6:
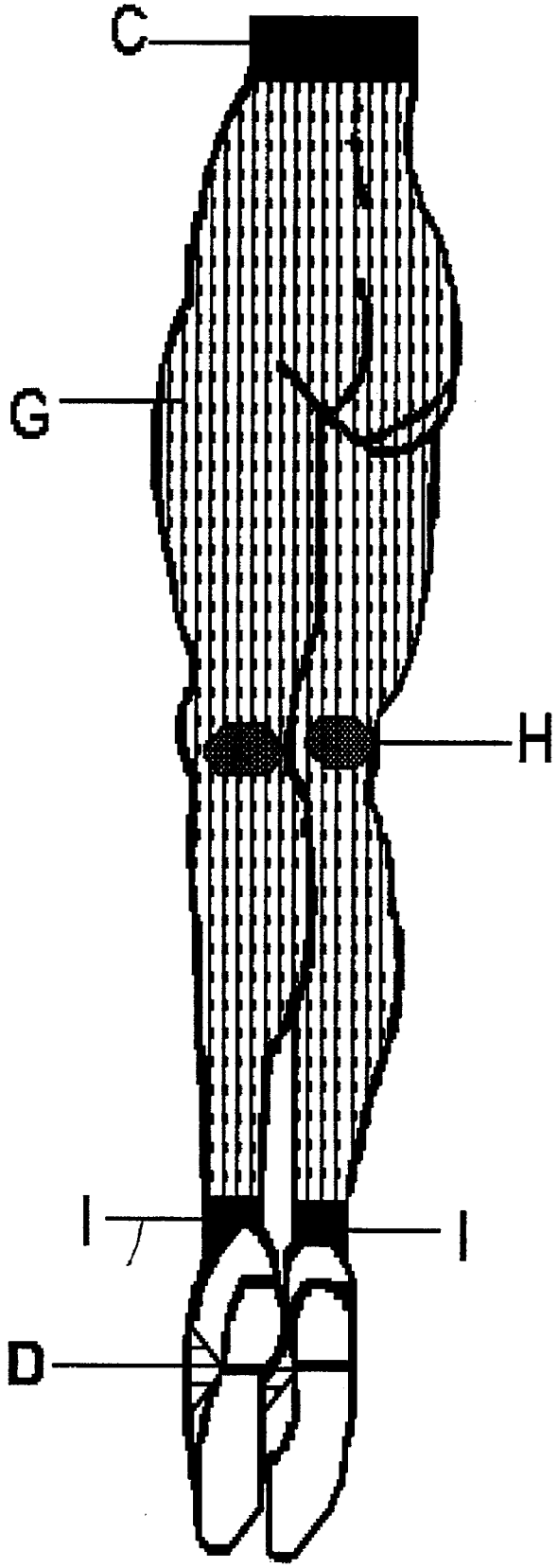
FIG. 6 illustrates a rear view of the leg portion and air ports at the back of the knees of the female version of the weighted exercise suit.

Turning descriptively to the drawings, in which similar reference characters denote similar elements throughout the several views. FIGS. 1 and 2 illustrate two frontal views of the weighted exercise suit while FIGS. 4 and 5 illustrate two running views of a female version of the invention. FIGS. 3 and 6 illustrate a rear view of the male and female leg portions of the fit to form weighted exercise suit.

FIG. 1 shows the elastic full body weighted exercise suit having weights (G) that are quilted between two elastic fabric layers (shown in FIGS. (7–10) including an inner and an outer fabric layer (2). In FIG. 1 reference letters (A) are weighted, tapered wrist bands comprised of the flexible weights disposed in the elastic fabric wrist bands that are attached to the forearm portion of the two quilted elastic fabric layers with elongated flexible weights quilted therein. Reference letter (B) refers to the single elastic fabric layer air ports which are designed into the weighted, elastic fabric exercise suit to allow ventilation and air cooling within the snug fitting elastic suit and to prevent friction between the jointed ligaments of the wearer's body. The air ports also allow for greater comfort and ease in bending and rotation of the arms and shoulders. The air ports are formed by eliminating the second outer fabric layer (2) and leaving just the inner fabric layer (1). The inner layer (1) is a lighter fabric and allows more flexibility and movement over the flexible weights. The resistance of the outer fabric layer (2) allows a comfortable and more conforming fit during athletic activities. The suit is constructed of the inner (1) and outer (2) fabric layers which are quilted over elongated polyurethane and metal blended flexible weights (G). The polyurethane rubber is blended with the metal fibers to produce the flexible weights (G). Reference letter (C) shows the high tension, elastic waistband which will serve as a centralized polarity, tension, lower back support. The flexible, weighted elastic waistband is attached to the upper, shirt portion and the lower pant half by sewing and fusion as is the collar, wristbands and ankle bands. Reference letter (D) depicts the high tension, elastic stirrups which are located at the feet of the full body versions of the suit and are attached to weighted pant hems. The stirrups (D) provide an added tension and downward polarity. The use of the downward polarity will become evident as the users perform exercise routines involving leg raising motions, such as running, jogging, aerobics and a myriad of leg exercises. Together with the weight of the suit, the polarity of the stirrups shall enhance and speed up the toning process for the wearer of the suit. Weighted ankle bands (I) add resistance to the legs of the wearer. Reference letter (E) refers to the weighted, tapered, flexible neck line that gives the wearer a centralized resistance starting at the center of the neck and shoulder areas thus enhancing the wearer's upper body workouts. Reference letter (F) refers to the zipper which is attached to the front center of the weighted, elastic body suit by sewing and fusion. The zipper shall be used for opening and closing the elastic exercise suit. The zipper shall extend through the high tension waistband to the crotch area of the elastic exercise suit. Reference letter (G) refers to the flexible, tubular weights that will range in increments of five pounds, ten pounds, fifteen pounds and so on, according to the wearer's preferences. Each flexible tubular weight is quilted between the two elastic fabric layers of the suit so that the weights are separated from one another by the quilted seams (S) of the suit. The tubular weights are run parallel to each other along the elongated length of the suit in any number desired and are attached to the weighted collar, armpit air ports, wrist bands, waist band, back knee air ports and hems. The suit is formed of breathable, fit to form elastic material to give whole body support to the wearer and to snugly support the flexible tubular weights within the layers as well. The flexible weights of the elastic exercise suit are designed to provide a balanced and symmetrical distribution of weight from the neck to the ankles, from the front to the back, and from side to side of the upper and lower body and every muscle and muscle group in between the neck and the ankles, rather than having the weight placed solely on either the lower, upper or just one specified area of the body.

FIG. 2 shows the male swimsuit version of the body suit which does not have leg portions. The suit is the same as the full body version shown in FIG. 1 and as described above except for the leg portions. Reference letters (A, B, C, E, F and G) all refer to the same suit components as in FIG. 1 and as described above in regard to FIG. 1. Reference letter K refers to a weighted thigh band that has the weighted material within the two layers that is the same as the wristbands (A) and the collar (E).

FIG. 3 shows the rear view of the lower leg portion of a full body exercise suit showing the air ports at the rear of the knees (H) which allow for ease and comfort in bending and air circulation. Reference letters (C and G) refer to the same suit components as in FIG. 1 and as described above in regard to FIG. 1. Reference letter (I) refers to the weighted ankle band, (J) to the trunk portion and (D) to the stirrups.

FIG. 4 shows the female version of the full body exercise suit which contains the same components (Reference letters A, C, D, F and G) as in FIG. 1 and as described above in reference to FIG. 1.

FIG. 5 shows the female, swimsuit version of the exercise suit which contains the same components as the male swimsuit version shown in FIG. 2 and as described above in regard to FIG. 2.

FIG. 6 shows the rear view of the lower leg portion of a female full body exercise suit showing the air ports at the rear of the knees (H) which allow for ease and comfort in bending and air circulation. Reference letters (C and G) refer to the same suit components as in FIG. 1 and as described above in regard to FIG. 1. Reference letter (I) refers to the weighted ankle band.

Figure 7:
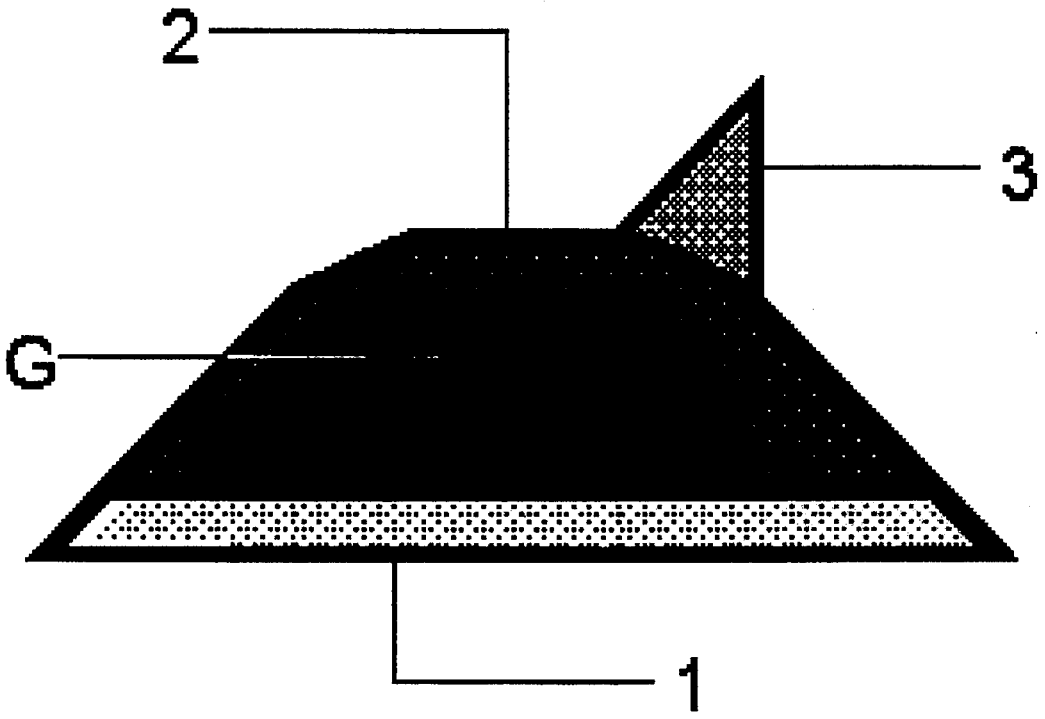
FIG. 7 illustrates a cross-sectional view of the flexible weight embodied in the weighted exercise suit.

FIG. 7 shows a cross-sectional view of flexible weight wherein reference number (2) is the outer layer, (3) is the optional decorative fabric layer, (G) refers to the longitudinal flexible weights and (1) is the inner layer.

Figure 8:
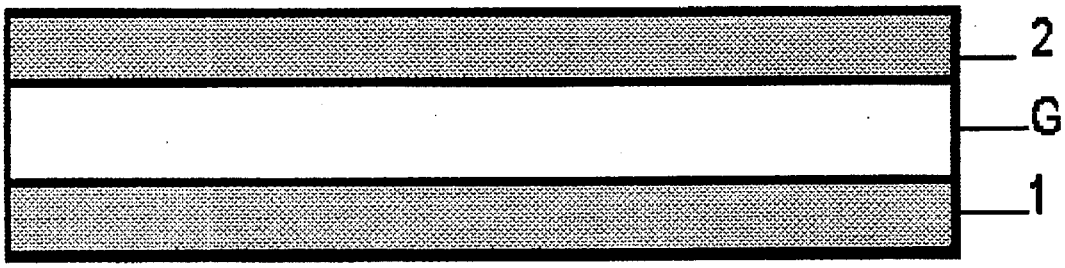
FIG. 8 illustrates a longitudinal cross-sectional view of the elongated, flexible weights and the quilted elastic fabric layers of the weighted exercise suit.

FIG. 8 is a longitudinal, cross-sectional view of the layers of the elastic exercise suit. The outer layer (2) is of an elastic material and the inner layer (1) is of an elastic material that is lighter weight and less resistant than the outer fabric layer (2). The elongated flexible weights (G) are sandwiched in between the first inner and second outer fabric layers and is held by quilting stitches in between the elongated flexible weights.

Figure 9:
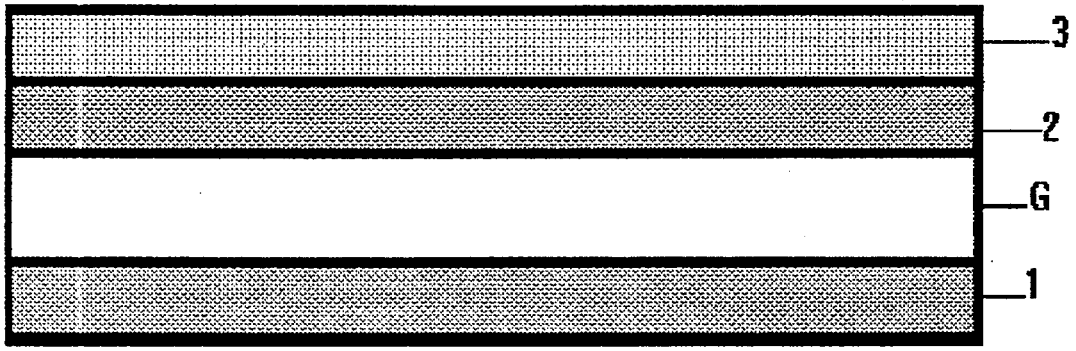
FIG. 9 illustrates a longitudinal cross-sectional view of the elongated, flexible weights and the quilted elastic fabric layers of the suit with the optional decorative layer.

FIG. 9 is a longitudinal, cross-sectional view of the layers of the elastic exercise suit. The outer layer (2) is of an elastic material and the inner layer (1) is of an elastic material that is lighter in weight and less resistant than the outer fabric layer (2). The elongated flexible weights (G) are sandwiched in between the first inner and second outer fabric layers and is held by quilting stitches in between the elongated flexible weights. A third layer (3), a decorative layer, which is formed of either spandex or latex material, is added and quilted to the suit on the outside of the suit over the outer layer (2) for decorative purposes.

Figure 10:
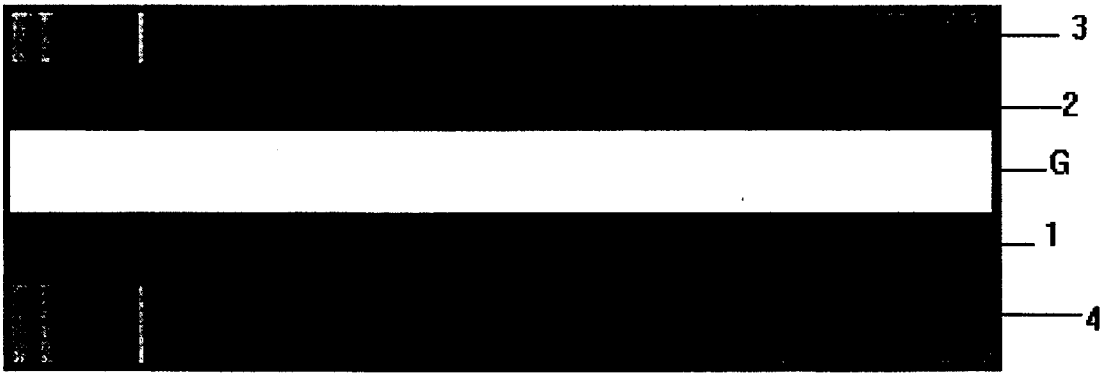
FIG. 10 illustrates a longitudinal cross-sectional view of the elongated, flexible weights and the quilted elastic fabric layers of the suit with the optional decorative layers and lining layer.

FIG. 10 is a longitudinal, cross-sectional view of the layers of the elastic exercise suit. The outer layer (2) is of an elastic material and the inner layer (1) is of an elastic material that is lighter in weight and less resistant than the outer fabric layer (2). The elongated flexible weights (G) are sandwiched in between the first inner and second outer fabric layers and is held by quilting stitches in between the elongated flexible weights. A third layer (3), a decorative layer, which is formed of either spandex or latex material, is added and quilted to the suit on the outside of the suit over the outer layer (2) for decorative purposes. A fourth layer (4), a lining material of cotton, is added to the interior of the suit inside of the inner layer (1) for comfort purposes and/or insulation.

The decorative layer (3) and the lining layer (4) are optional and can be added to the suit as desired.

I claim:

1. A one piece stretchable and weighted body toning suit designed to be worn by its users to strengthen and tone their bodies comprising:

a full body covering suit including a torso covering portion, sleeves, long leg portions having ends with stirrups, a waistband; wristbands and a neck opening;

said suit formed of two elastic fabric layers including a first inner layer and a second outer layer;

a plurality of elongated flexible weights inserted between said inner and outer elastic fabric layers;

said weights run parallel to each other along the length of the suit;

said inner and outer elastic fabric layers are quilted together by any one of stitching, fusion or a combination of both, adjacent and extending along the length of the elongated flexible weights to secure said elongated flexible weights within said suit;

said waistband being weighted;

said neck opening including a weighted tapered neckline;

said wristbands being weighted;

said inner elastic fabric layer being lighter in weight than the outer elastic fabric layer.

2. A body toning suit as claimed in claim 1 further comprising a third fabric layer of decorative material attached to said inner and outer elastic fabric layers by said stitching, fusion or combination of both.

3. A body toning suit as claimed in claim 2 wherein said third layer of decorative fabric material comprising any one of spandex, latex or other stretchable material.

4. A body toning suit as claimed in claim 2 wherein said third fabric layer of decorative material is comprised of latex.

5. A body toning suit as claimed in claim 1 further comprising a fourth layer of lining material attached to said inner and outer elastic fabric layers by said stitching, fusion or combination of both.

6. A body toning suit as claimed in claim 2 further comprising a fourth layer of lining material attached to said inner and outer elastic fabric layers by said stitching, fusion or combination of both.

7. A body toning suit as claimed in claim 3 further comprising a fourth layer of lining material attached to said inner and outer elastic fabric layers by said stitching, fusion or combination of both.

8. A body toning suit as claimed in claim 4 further comprising a fourth layer of lining material attached to said inner and outer elastic fabric layers by said stitching, fusion or combination of both.

9. A one piece stretchable and weighted body toning suit designed to be worn by its users to strengthen and tone their torso, buttocks and arms comprising:

a torso, buttocks and arm covering suit including a torso covering portion, a buttocks covering portion, sleeves, a waistband; wristbands and a neck opening;

said suit formed of two elastic fabric layers including a first inner layer and a second outer layer;

a plurality of elongated flexible weights inserted between said inner and outer elastic fabric layers;

said weights run parallel to each other along the length of the suit;

said inner and outer elastic fabric layers are quilted together by stitching, fusion or combination of both adjacent and extending along the length of the elongated flexible weights to secure said elongated flexible weights within said suit;

said waistband being weighted;

said neck opening including a weighted tapered neckline;

said wristbands being weighted;

said inner elastic fabric layer being lighter in weight than the outer elastic fabric layer.

10. A body toning suit as claimed in claim 9 further comprising a third fabric layer of decorative material attached to said inner and outer elastic fabric layers by said stitching, fusion or combination of both.

11. A body toning suit as claimed in claim 10 wherein said third layer of decorative fabric material is comprised of spandex.

12. A body toning suit as claimed in claim 10 wherein said third fabric layer of decorative material is comprised of latex.

13. A body toning suit as claimed in claim 9 further comprising a fourth layer of lining material attached to said inner and outer elastic fabric layers by said stitching, fusion or combination of both.

14. A body toning suit as claimed in claim 10 further comprising a fourth layer of lining material attached to said inner and outer elastic fabric layers by said stitching, fusion or combination of both.

15. A body toning suit as claimed in claim 11 further comprising a fourth layer of lining material attached to said inner and outer elastic fabric layers by said stitching, fusion or combination of both.

16. A body toning suit as claimed in claim 12 further comprising a fourth layer of lining material attached to said inner and outer elastic fabric layers by said stitching, fusion or combination of both.

* * * * *